US006786271B2

(12) United States Patent
Ishiduka et al.

(10) Patent No.: US 6,786,271 B2
(45) Date of Patent: Sep. 7, 2004

(54) METAL OBJECT FORMING METHOD UTILIZING FREEZING POINT DEPRESSION OF MOLTEN METAL

(75) Inventors: Masanobu Ishiduka, Kawasaki (JP); Noriyasu Aso, Kawasaki (JP); Kouta Nishii, Kawasaki (JP); Koichi Kimura, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/209,874

(22) Filed: Aug. 2, 2002

(65) Prior Publication Data

US 2003/0034145 A1 Feb. 20, 2003

(30) Foreign Application Priority Data

Aug. 3, 2001 (JP) ..... 2001-236008
Apr. 10, 2002 (JP) ..... 2002-107566

(51) Int. Cl.[7] ..... B22C 3/00
(52) U.S. Cl. ..... 164/72; 164/267
(58) Field of Search ..... 164/72, 113, 267

(56) References Cited

U.S. PATENT DOCUMENTS 2,629,907 A * 2/1953 Hugger ..... 164/14
2,645,558 A * 7/1953 Burchartz ..... 427/135
4,298,051 A * 11/1981 Page ..... 164/72
5,033,532 A * 7/1991 Aoyama ..... 164/72
5,279,749 A 1/1994 Hanano
5,337,800 A * 8/1994 Cook ..... 164/72
6,506,443 B1 * 1/2003 Peschges et al. ..... 427/133

FOREIGN PATENT DOCUMENTS

EP 0 799 901 A1 10/1997
JP 5-92232 4/1993
JP 9-272945 10/1997

* cited by examiner

*Primary Examiner*—Kiley Stoner
*Assistant Examiner*—Len Tran
(74) *Attorney, Agent, or Firm*—Armstrong, Kratz, Quintos, Hanson & Brooks, LLP

(57) ABSTRACT

A metal object forming method includes a preliminary step and a metal-injecting step. At the preliminary step, flowability-improving material is put in a molding die. Then, at the metal-injecting step, molten metal is poured into the die for producing a casting. Due to the high temperature of the molten metal, the flowability-improving material melts into the molten metal, to cause the freezing point depression of the molten metal.

12 Claims, 9 Drawing Sheets

METAL OBJECT FORMING METHOD UTILIZING FREEZING POINT DEPRESSION OF MOLTEN METAL

BACKGROUND OF THE INVENTION

1. Field of the Invention

The present invention relates to a metal object forming method which is advantageously used for producing a metal housing of portable electronic devices such as notebook computers and cell phones. The present invention also relates to a metal housing produced by the method.

2. Description of the Related Art

In portable electronic devices including notebook computers, cell phones, etc., the housing is often made of light metal (e.g., magnesium alloy or aluminum alloy) for attaining weight reduction and good heat dissipation. Such a metal housing, which often includes thin walls and complex shapes, can be produced by a die-casting technique. As is known, in die-casting, use is made of dies, or molds, that are designed to define a cavity corresponding to the desired shape. Molten metal is injected into the die cavity, in which the supplied metal hardens. Then, the die is opened, and the finished casting is ejected. A die-casting technique is disclosed in JP-A-9(1997)-272945, for example.

The conventional die-casting technique has found disadvantageous in the following respects.

In general, the molten metal injected into the die cavity will cool due to the heat conduction from the molten metal to the dies. When the cavity includes a relatively large portion and a relatively narrow portion, the molten metal tends to cool more sharply in the narrow portion than in the spacious portion. Unfavorably, the flowability of the molten metal becomes poorer as the temperature of the metal lowers. Accordingly, the molten metal in the narrow portion may harden before it can reach the end of the cavity. By a conventional die-casting technique, such a defect often results when the narrow portion of the die cavity is no greater than 1.5 mm.

Turning to another aspect of the conventional technique, a mold-releasing agent is often used for performing die-casting so that the resultant casting is readily separated from the cavity-defining surfaces of the die. JP-A-5(1993)-92232, for example, discloses a mold-releasing agent containing powered boron nitride, silicon nitride or mica. According to the teaching of this JP document, the mold-releasing agent is applied to the cavity-defining surfaces of the die, and then molten metal is injected into the closed dies. In this manner, the injected metal is spaced from the cavity-defining surfaces of the die by the particles contained in the mold-releasing agent. Thus, the resultant casting can be readily ejected from the dies. It should be noted, however, that this conventional mold-releasing agent can work for facilitating the separation of the casting from the dies, but not for improving the flowability of the molten metal.

SUMMARY OF THE INVENTION

The present invention has been proposed under the circumstances described above. It is, therefore, an object of the present invention to provide a metal object forming method whereby a metal object with thin walls can be produced properly without suffering a defect resulting from poor flowability of the molten metal. Another object of the present invention is to provide a housing of an electronic device that is produced by such a method.

According to a first aspect of the present invention, there is provided a metal object forming method. At a preliminary step, a molding die is supplied with flowability-improving material which melts into molten metal and causes the freezing point depression of the molten metal. At a subsequent injecting step, molten metal is supplied into the die for producing a casting.

Preferably, the flowability-improving material may include metal particles contained in lubricant. At the preliminary step, this lubricant is applied to a cavity-defining surface of the die. At the injecting step, the molten metal is supplied at a temperature high enough to melt at least part of the metal particles.

Preferably, the metal particles may be coated with thermoplastic resin such as olefin resin, acrylic resin or styrene resin.

Preferably, the particles may have a diameter of 1~100 $\mu$m.

Preferably, the lubricant may contain 5~30 wt % of metal particles.

Preferably, the flowability-improving material may include a metal plate. At the preliminary step, the metal plate is disposed on a cavity-defining surface of the die. At the injecting step, the molten metal is supplied at a temperature high enough to melt at least part of the metal plate.

Preferably, the flowability-improving material may include zinc or zinc-based alloy, while the molten metal may include magnesium or magnesium-based alloy.

Preferably, the zinc-based alloy may contain 60~95 wt % of zinc and 5~40 wt % of tin.

According to a second aspect of the present invention, there is provided a housing of an electronic device, wherein the housing is produced by the above-mentioned method.

Other features and advantages of the present invention will become apparent from the detailed description given below with reference to the accompanying drawings.

DETAILED DESCRIPTION OF THE PREFERRED EMBODIMENTS

Preferred embodiments of the present invention will be described below with reference to the accompanying drawings.

Figure 1:
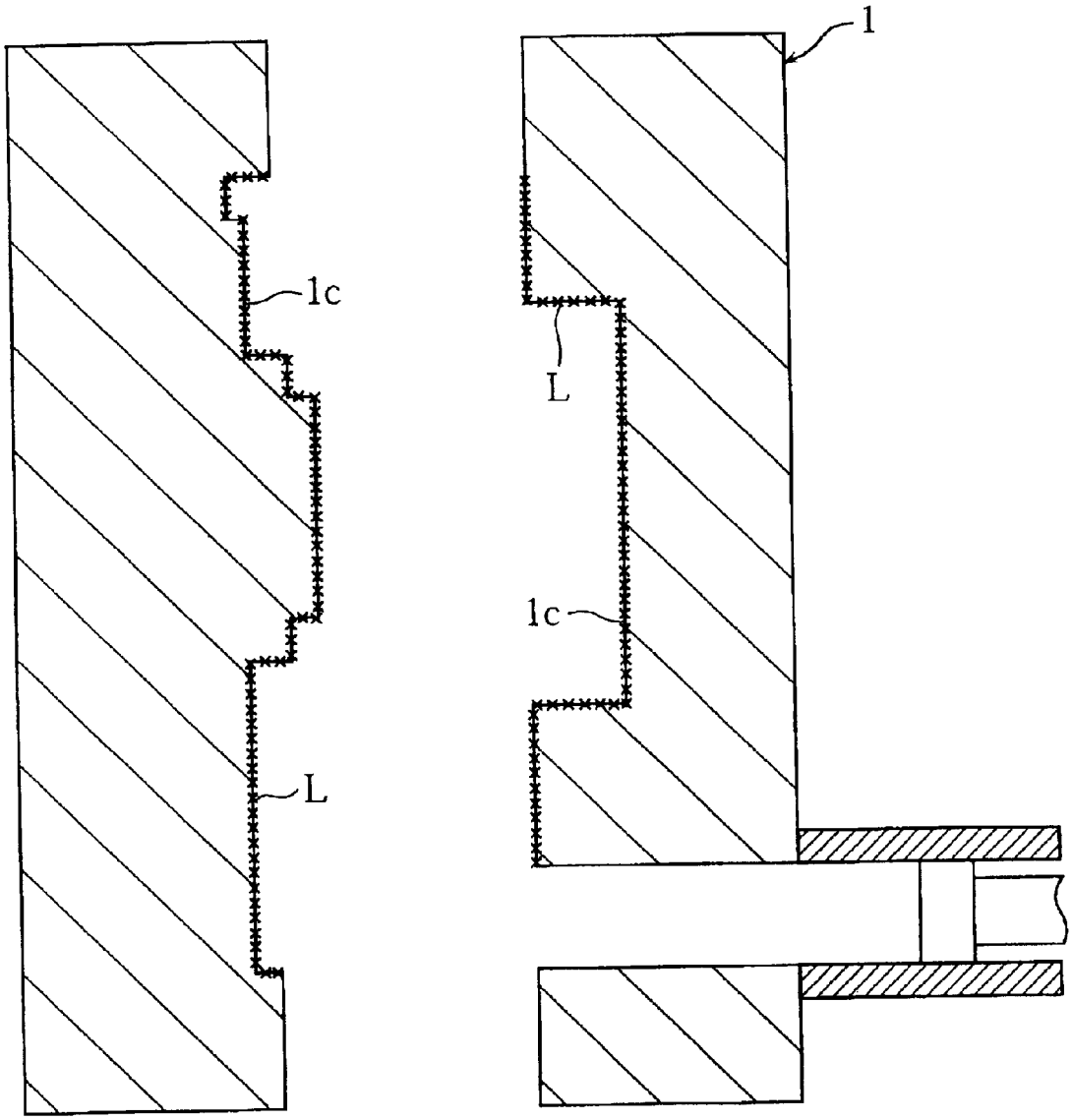
FIG. 1 illustrates molding dies to which flowability-improving material is applied in accordance with a method of the present invention.

FIGS. 1~4 illustrate some of the steps of a metal object forming method according to a first embodiment of the present invention. As shown in FIG. 1, the dies 1 have a cavity-defining surface 1*c* to which lubricant L is applied in a spray. The lubricant L may be composed of lubricating liquid and lubricating particles dispersed in the liquid.

The lubricating liquid may be silicone oil or aqueous emulsion mold-releasing agent. A surface-active agent, anti-foaming agent or thickening agent may be added to the silicone oil.

The lubricating particles may be made of pure zinc or zinc-based alloy. To properly melt in the molten metal injected into the dies 1, the zinc-based alloy may need to have particular composition. For example, the alloy may contain 40 wt % tin, so that it will melt at about 350° C. (liquidus temperature) and solidify at about 200° C. (solidus temperature).

Preferably, the zinc or zinc-based particles may be coated with thermoplastic resin. In this manner, it is possible to prevent the zinc or zinc-based particles ("core particles" in the context here) from becoming an oxide or hydroxide by being exposed to the air or the lubricant L for a long time. Without being coated, the particles can be affected by the air or the lubricant L, which may deteriorate the lubricity or dispersibility of the lubricant L. Examples of the thermoplastic resin to be used are olefin resin (such as polypropylene or polyethylene), styrene resin (such as polystyrene or acrylonitrile-styrene copolymer), or acrylic resin, which may be water-soluble or non-water-soluble. These resin materials may be used alone or mixed. Their melting temperatures are about between 150° C. and 300° C. Thus, in using these resins, the cavity-defining surfaces 1*c* of the dies 1 are heated up to an appropriate temperature in this range.

The resin coating of the core particles may be performed in the following manner. First, suitable resin material selected from the above-mentioned kinds is heated to melt. Then, core particles are added to the molten resin. This mixture is agitated for uniform distribution of the core particles in the resin. Finally, the resin-particle mixture is cooled for hardening, so that the core particles are embedded in the resin material. The thus obtained resin lump is broken into fragments before dispersed in the lubricating liquid. Alternatively, the particle resin-coating may be performed by dissolving resin material in a suitable solvent, adding core particles to the solvent, agitating the particle-added solvent, and vaporizing the solvent.

The lubricant L contains 5~30 wt % of lubricating particles. This range of particle content allows the lubricant L to flow properly, while also enabling uniform particle distribution over the cavity-defining surfaces 1*c* in applying the lubricant L to these surfaces.

In the illustrated embodiment, the diameter of the zinc or zinc-based alloy particle is preferably 1~100 $\mu$m. If the diameter is less than 1 $\mu$m, the spray nozzle may be clogged in spraying the lubricant L. If it is more than 100 $\mu$m, the particles may fail to be dispersed properly in the lubricating liquid, which makes it difficult to apply the particles evenly over the cavity-defining surfaces 1*c*.

The addition and mixture of the lubricating particles are performed just before the application of the lubricant L to the cavity-defining surfaces 1*c*. While the application is being performed, it is desirable to constantly agitate the lubricant L to be used so that the lubricating particles are not sedimented. Depending on the viscosity of the lubricant L, the churning rate may be 10~1000 rpm. The sedimentation of the particles can be reduced by using a resin of small specific gravity, such as polypropylene, for coating the particles.

When the lubricant L is applied to the heated cavity-defining surfaces 1*c* (about 150–300° C.), moisture (if any) will evaporate from the lubricant L. Then, when use is made of the resin-coated particles, the thermoplastic film is melted, to expose the core particles. Owing to the molten resin material, the core particles adhere well to the cavity-defining surfaces 1*c*.

Figure 2:
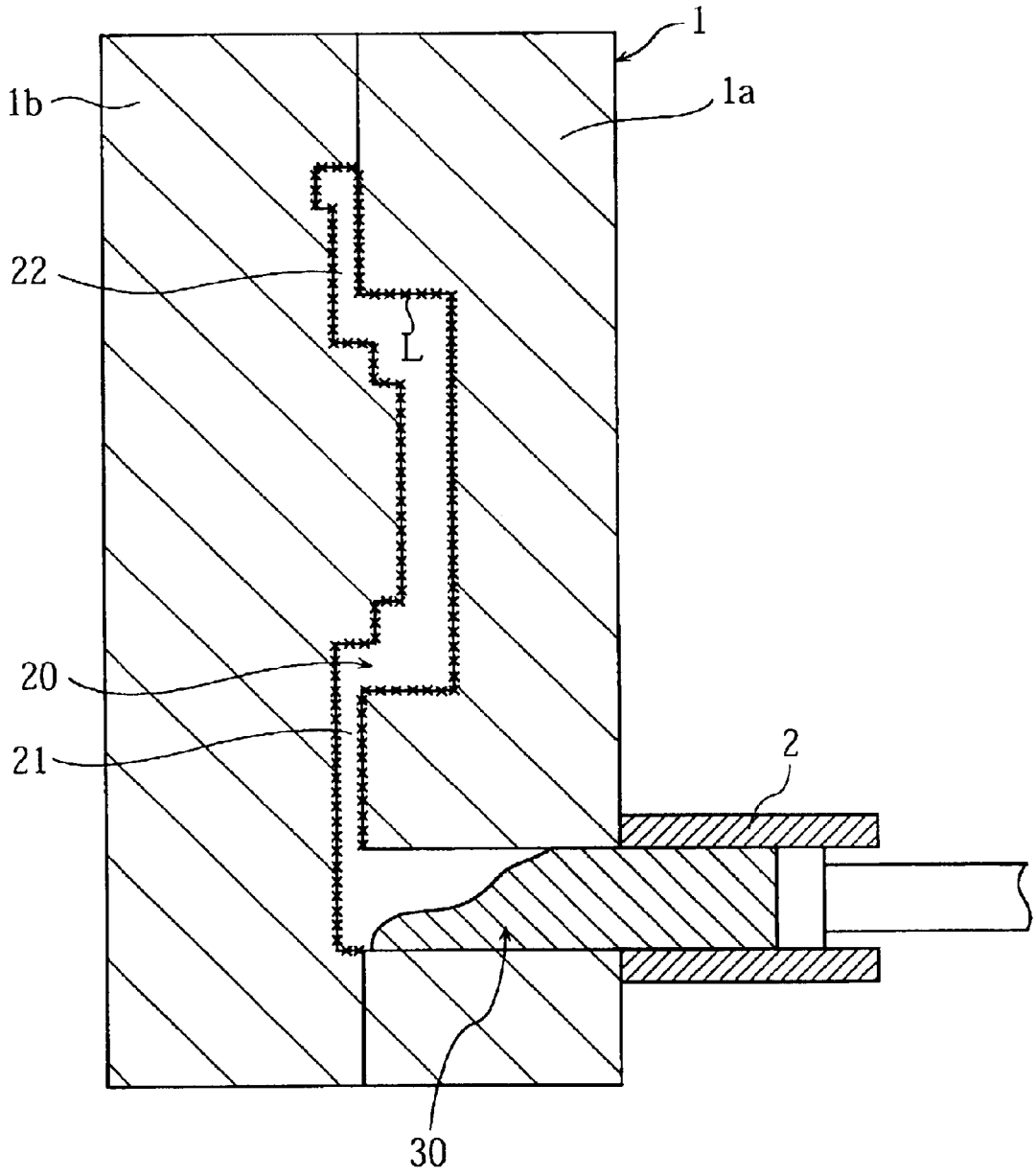
FIG. 2 illustrates the molding dies closed for injection of molten metal.

Then, the dies 1 are closed, as shown in FIG. 2, to form a desired cavity 20. The dies 1 consist of a stationary die 1*a* and a movable die 1*b*. The cavity 20 includes a gate space 21 and an overflow space 22. The gate space 21 is provided for introducing molten metal 30 into the cavity 20. The molten metal is injected into the cavity 20 from a casting sleeve 2.

The metal 30 is preferably light metal (such as aluminum or magnesium) whose density is no more than 5 g/cm$^3$ or a light metal alloy. With the use of such a light material, a light housing suitable for a notebook computer or cell phone can be produced.

Figure 3:
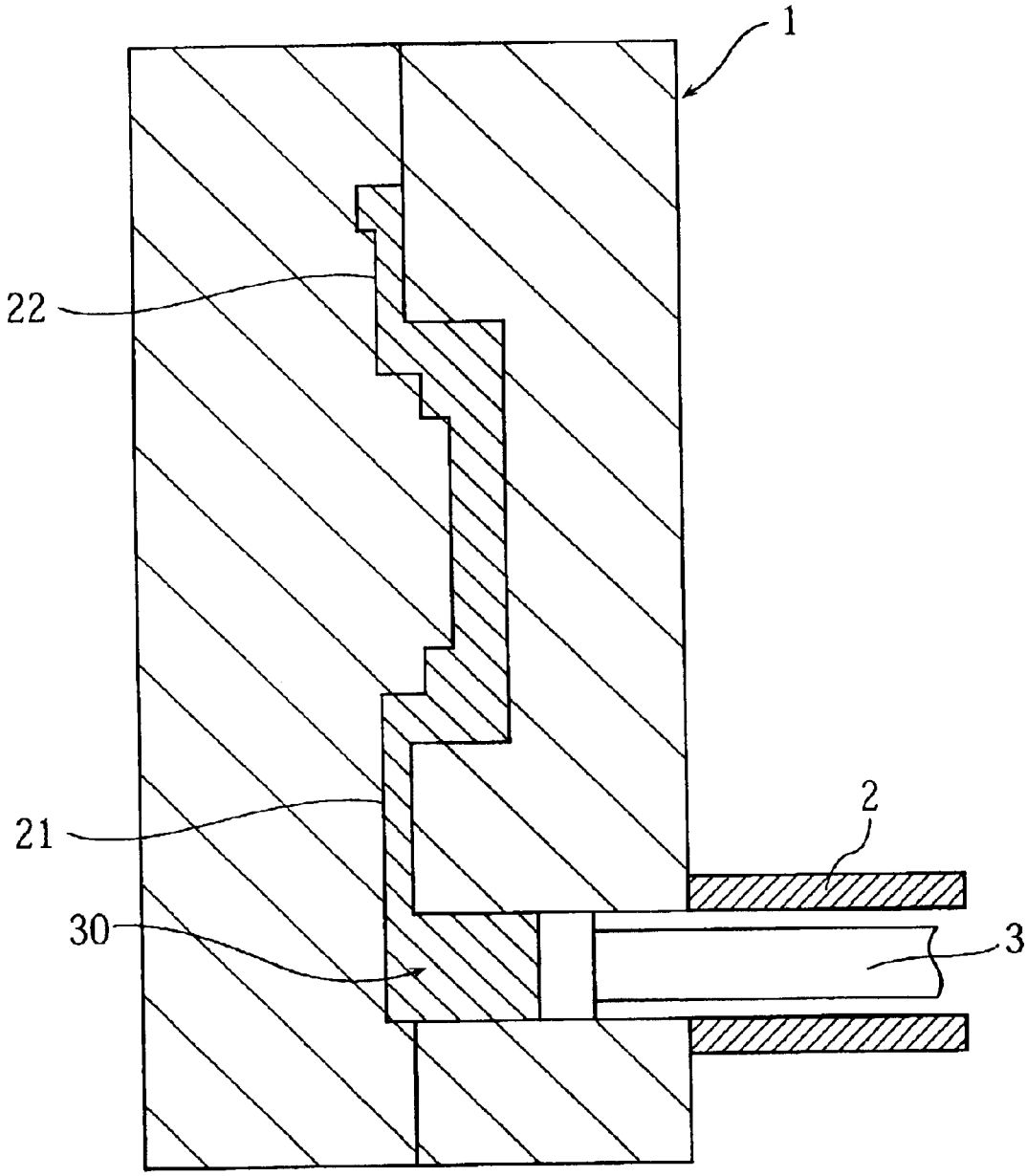
FIG. 3 shows the die cavity filled with injected molten metal.

Then, as shown in FIG. 3, the advance of a plunger 3 arranged in the casting sleeve 2 impels the molten metal 30 into the cavity 20. At this stage, the temperature of the metal 30 is 600~700° C., while the temperature of the dies 1 is 150~300° C. depending upon the kind of the metal 30. The injected metal 30 flows through the gate space 21 and fills the overflow space 22.

When the molten metal 30 is introduced into the cavity 20, part of the lubricant L applied to the cavity-defining surfaces 1*c* is taken into the metal 30 flowing in the cavity. Then, being heated up by the molten metal 30, the lubricating particles (made of zinc, which melts at about 420° C., or zinc-based alloy) contained in the lubricant L will melt and mix with the hot metal 30. As a result, an alloy is produced as the combination of the melted particles and the metal 30 flowing adjacent to the cavity-defining surfaces 1*c*.

Due to the mixing with the zinc material, the alloyed outer-layer region of the metal 30 has a reduced freezing point. This means that the metal 30 can maintain appropriate flowability in the cavity 20 even after some heat of the metal 30 is conducted to the dies 1. Thus, the metal 30 flows well in the cavity 20 to fill any narrow portion of the cavity. When the metal 30 is made of aluminum or aluminum-based alloy (such as Si-based ADC3 or Mg-based ADC5) and contains a 50 wt % of zinc, the molten metal 30 has a freezing point of about 450° C. When the metal 30 is made of magnesium or magnesium-based alloy (such as Al-based AM60 or Al—Zn-based AZ91) and contains a 50 wt % of zinc, the molten metal 30 has a freezing point of about 340° C.

While part of the lubricating particles is taken into the metal 30 flowing in the cavity 20, the other part of them remains on the cavity-defining surfaces 1*c*. Advantageously, these remnant particles reduce the friction between the flowing metal 30 and the cavity-defining surfaces 1*c*.

The above two features (i.e., the freezing-point depression of the metal 30 and the reduction of friction) both serve to keep good flowability of the molten metal 30 injected into the cavity 20. As a result, the pressure for impelling the molten metal 30 into the cavity 20 can be low. In addition, it is possible to overcome the shorts of the molten metal and provide the resultant casting with a smooth surface.

Figure 4:
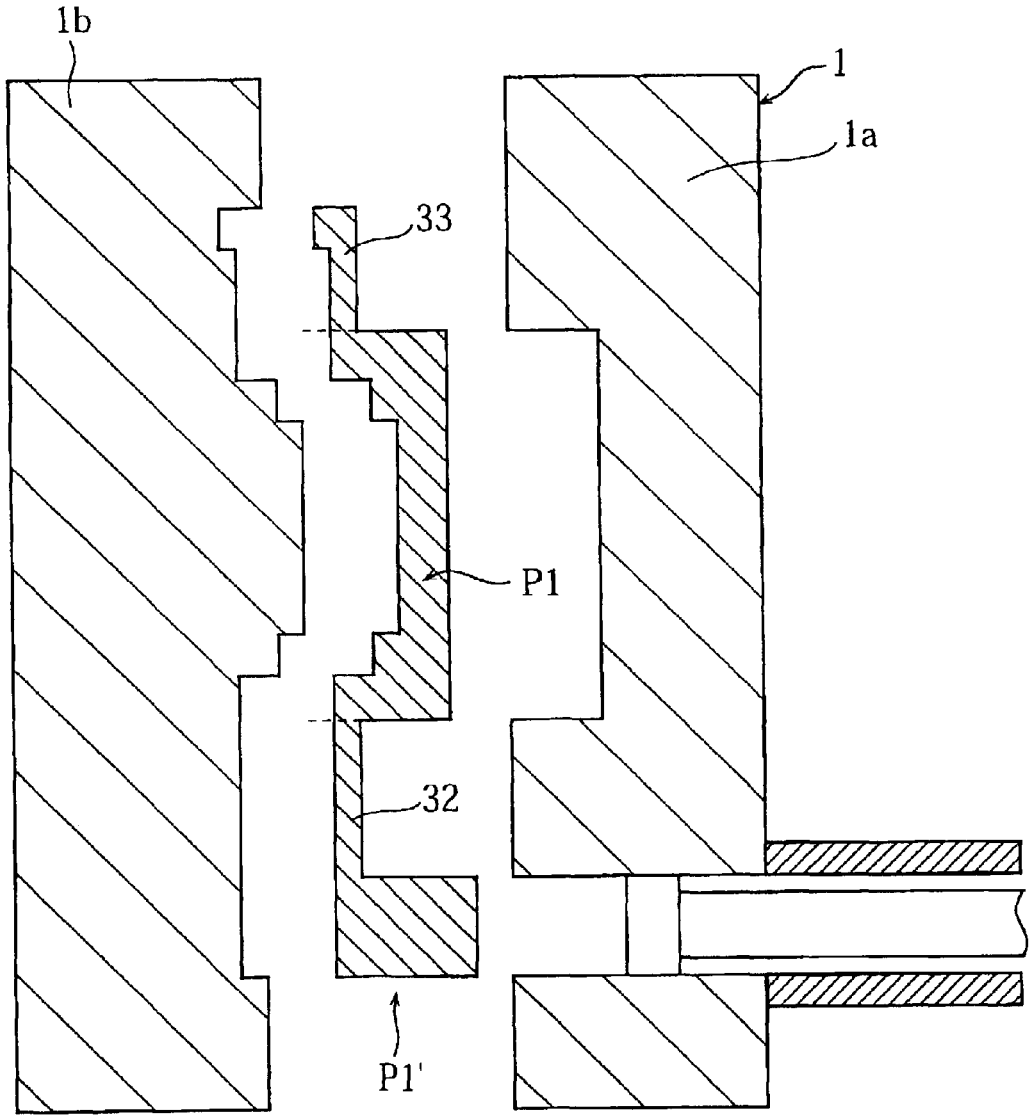
FIG. 4 shows a casting ejected from the separated molding dies.

After the metal 30 is appropriately cooled, the dies 1 are opened, as shown in FIG. 4, by separating the movable die 1*b* from the stationary die 1*a*. The obtained casting P1' includes unnecessary portions such as a gate part 32 and an overflow part 33. These unnecessary parts are removed by cutting the casting P1' along the prescribed cut lines (broken lines), so that the desired product P1 is obtained.

Reference is now made to FIGS. 5~8 illustrating a metal object forming method according to a second embodiment of the present invention.

Figure 5:
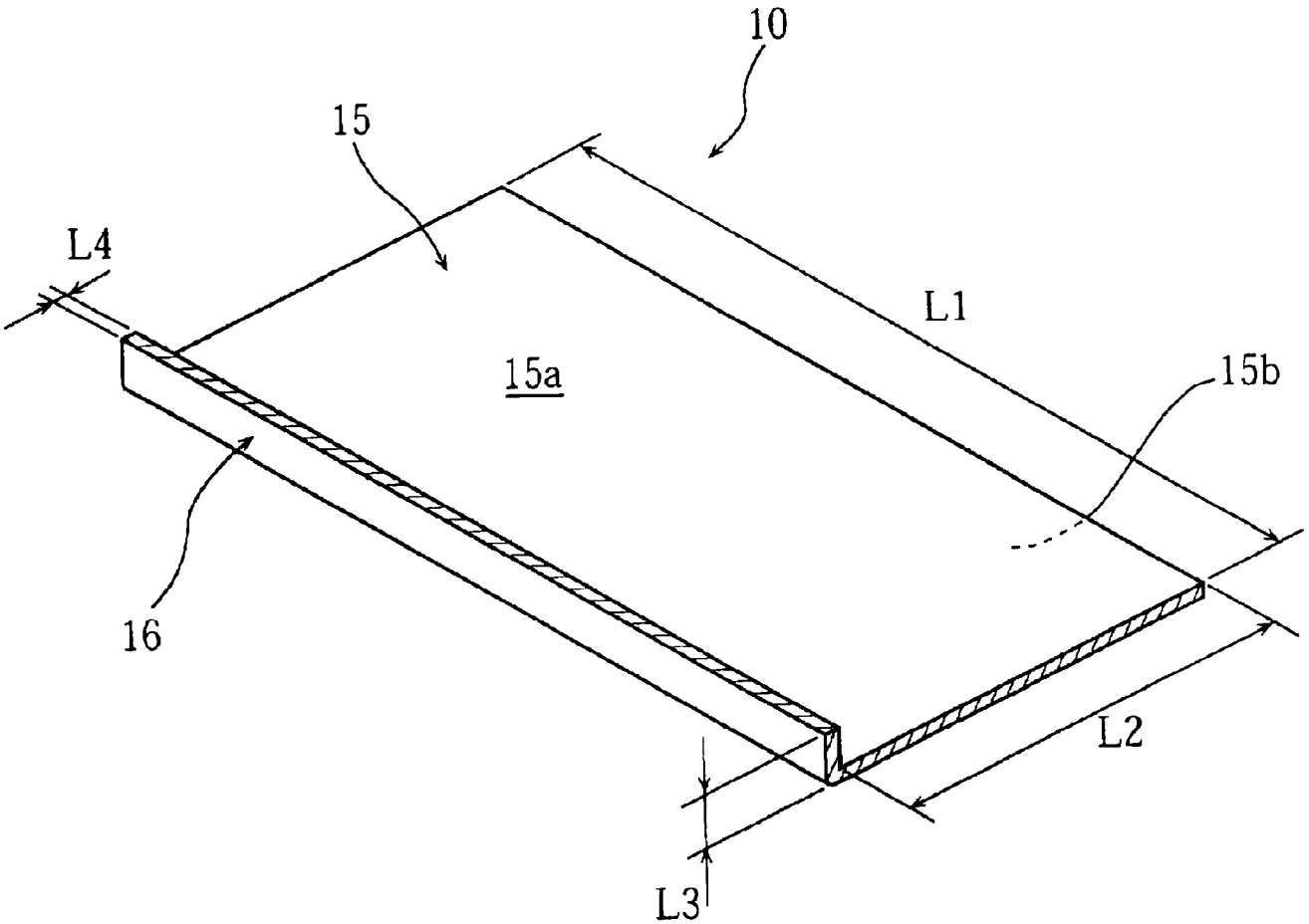
FIG. 5 is a perspective view showing a flowability-improving metal plate used in accordance with a second embodiment of the present invention.

FIG. 5 shows a metal plate 10 used for the method. The plate 10 is made of zinc (purity 99.99%) and consists of a main portion 15 and an auxiliary portion 16 perpendicular to the main portion 15. The main portion 15 has a first surface 15*a* and a second surface 15*b* opposite to the first surface 15*a*. The length L1 of the main portion 15 is 100 mm and the width L2 is 50 mm. The height L3 of the auxiliary portion 16 is 2.0 mm. The thickness L4 of the plate 10 is 0.3 mm.

Figure 6:
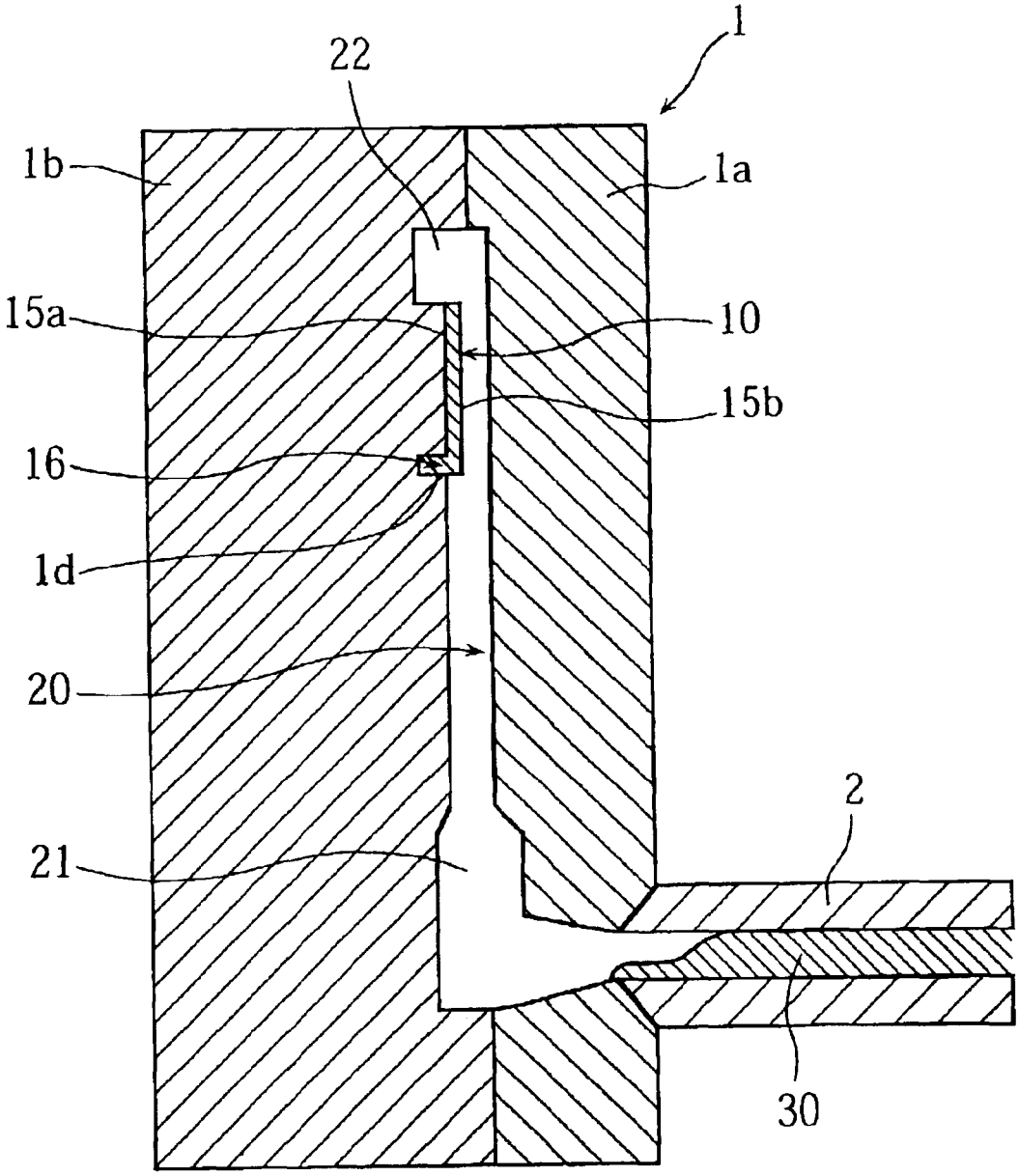
FIG. 6 shows how the flowability-improving metal plate of FIG. 5 is held in place within the die cavity.

According to the method of the second embodiment, the metal plate 10 is attached to the stationary die 1*b* in the manner shown in FIG. 6. Specifically, the die 1*b* is formed with a positioning groove 1*d* into which the auxiliary portion 16 of the plate 10 is press-fitted. In the fixed state, the first surface 15*a* of the main portion 15 is held in contact with the die 1*b*, while the second surface 15*b* is exposed to the cavity 20. After the positioning of the plate 10, the dies 1 are closed by bringing the movable die 1*a* into contact with the stationary die 1*b*. As in the previous embodiment, the thus formed cavity 20 includes a gate space 21 and an overflow space 22. Molten metal 30 is injected into the cavity 20 from a casting sleeve 2.

Figure 7:
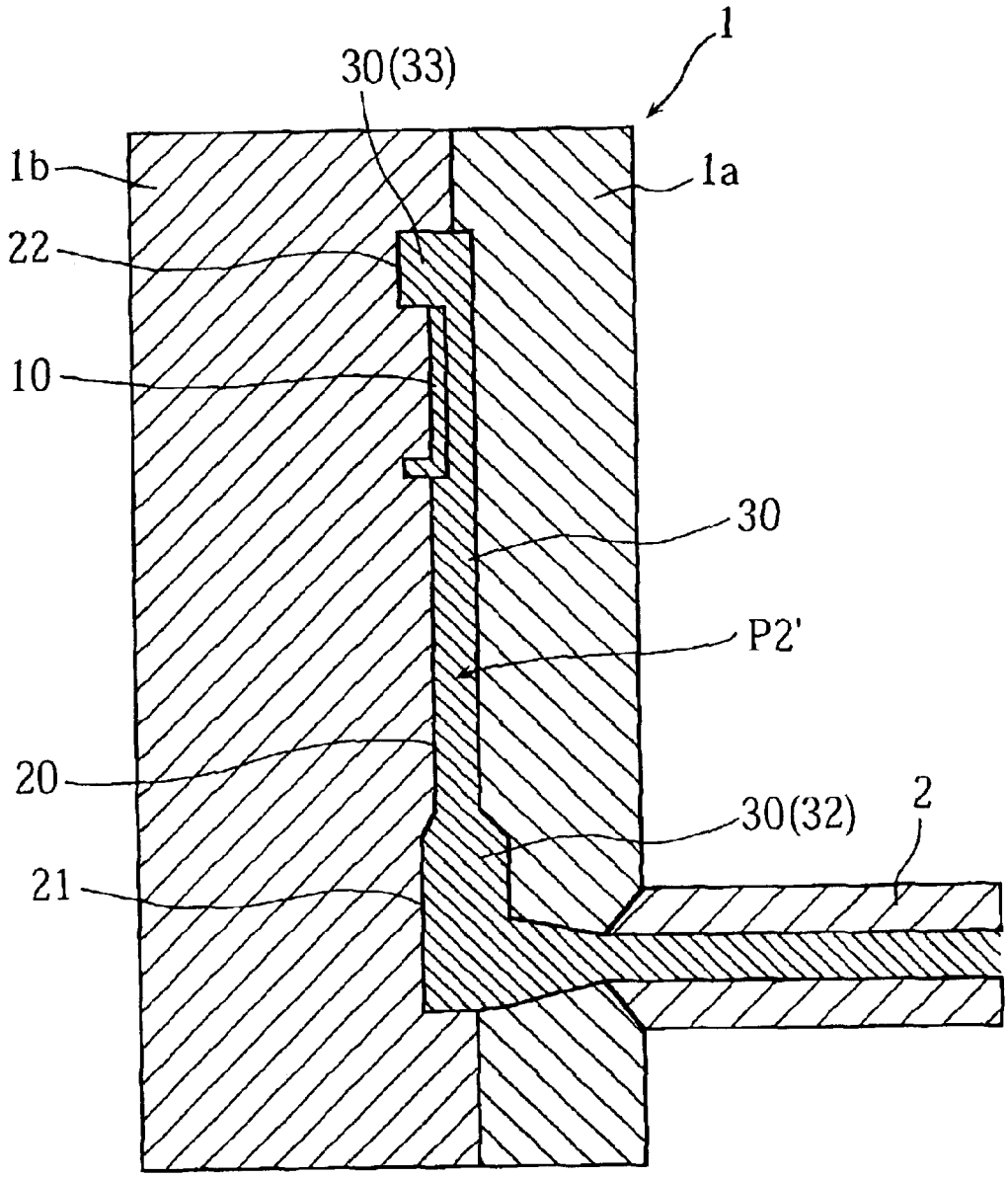
FIG. 7 shows the die cavity filled with injected molten metal.
Figure 8:
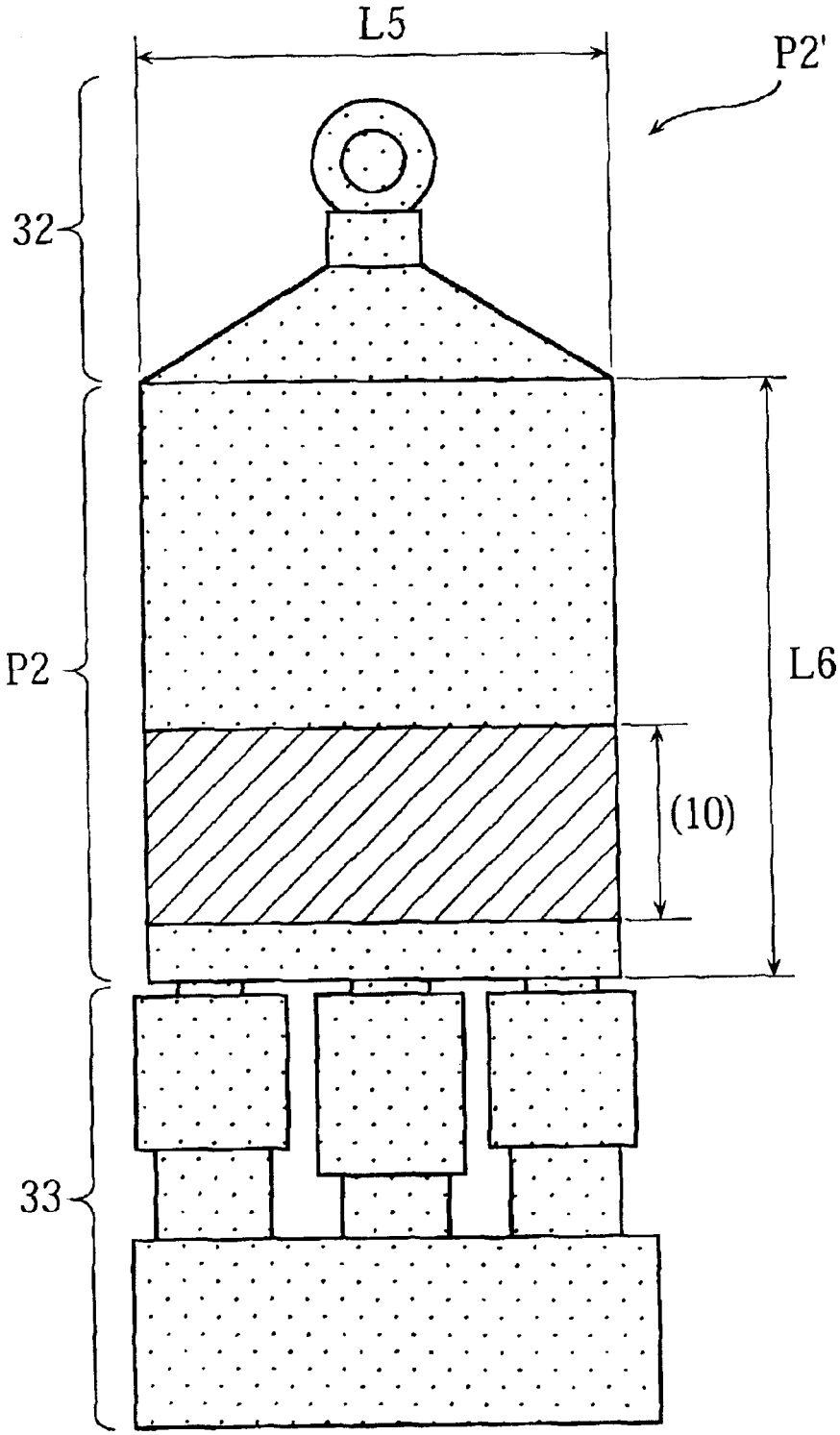
FIG. 8 is a plan view showing the casting obtained by the second embodiment of the present invention.

Then, as shown in FIG. 7, the molten metal 30 is injected under pressure into the cavity 20 by a plunger (not shown) arranged in the casting sleeve 2. The metal 30 may be made of magnesium-based alloy such as AZ91D (by ASTM). The AZ91D generally contains 9 wt % of Al, 1 wt % of zinc and 90 wt % of magnesium. The dies 1 are heated up to a temperature of 150~300° C. depending upon the kind of the molten metal 30. The injected metal 30 flows through the gate space 21 and to the metal plate 10. Upon touching the molten metal 30, the plate 10 will melt partially or entirely and mix with the metal 30, thereby increasing the Zn-content in the metal 30. As in the previous embodiment, this causes the depression of freezing point of the metal 30, thereby allowing the metal 30 to maintain its good flowability. After the overflow space 22 is filled, the metal 30 is allowed to cool while the dies 1 are still closed. Thus, a casting P2', integral with the metal plate 10 (if it is not entirely melted), is produced.

After the casting P2' is cooled sufficiently, the dies 1 are opened by separating the movable die 1*b* from the stationary die 1*a*, and the casting P2' is ejected. At this stage, the casting P2' includes unnecessary parts such as a triangular gate part 32 and an overflow part 33. These parts will be removed with the use of a cutter for example, so that the desired product P2 is obtained. In the illustrated example, the width L5 of the product P2 is 100 mm, the length L6 is 150 mm, and the thickness is 0.8 mm.

The location of the metal plate 10 shown in FIG. 6 is exemplary and should not be interpreted as limitative. According to the present invention, the plate 10 may be disposed upstream of the molten metal flow from any place where the molten metal 30 would otherwise stagnate. The metal plate 30 may not necessarily be made of zinc but any other substance that can melt into the molten metal 30 and lower the freezing point of the metal 30. For instance, the plate 30 may be made of an aluminum alloy, magnesium alloy, zinc alloy or tin alloy.

Figure 9:
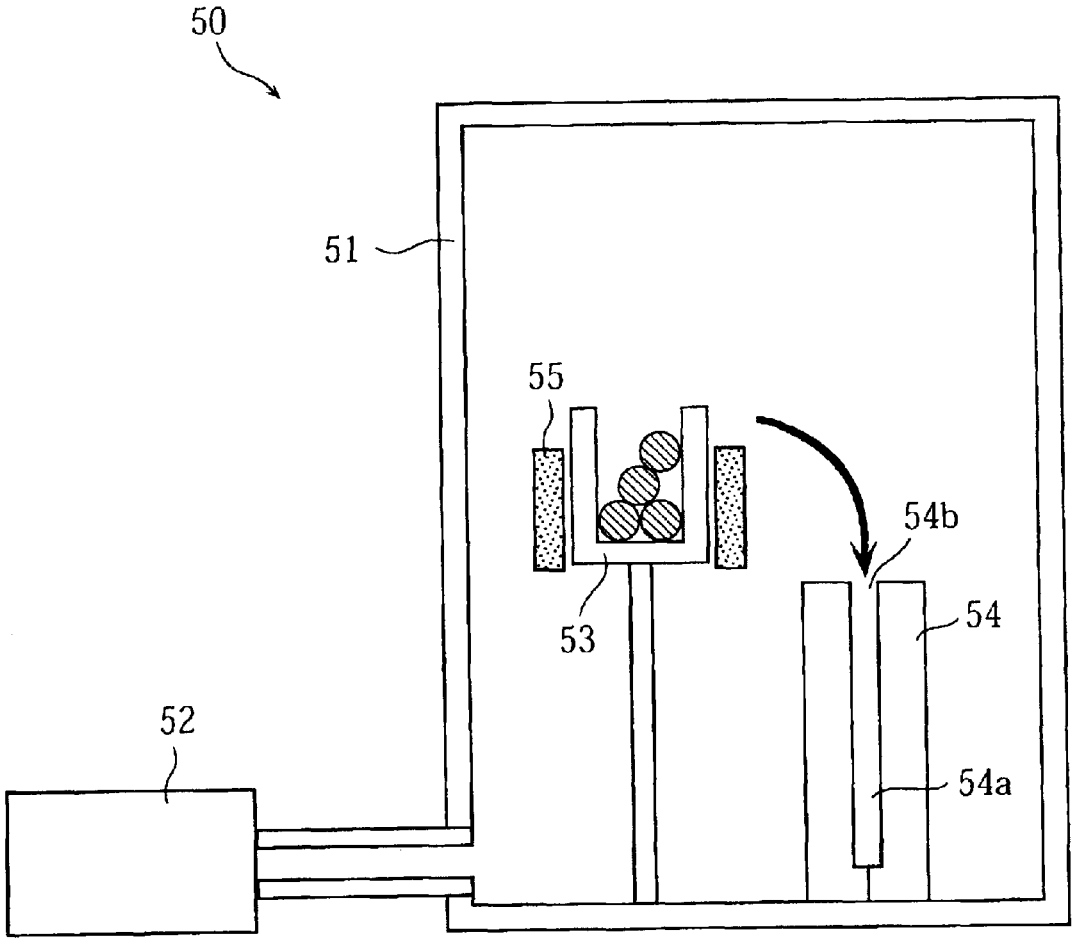
FIG. 9 shows the basic features of a metal object forming apparatus used for molding sample plates.

Referring now to FIG. 9 and TABLE given below, Examples 1~8 in accordance with the present invention and Comparative Cases 1 and 2 will be described. Examples 1~7 correspond to the above-described first embodiment, while Example 8 corresponds to the above-described second embodiment.

EXAMPLE 1

<Preparation of Lubricant>

The lubricant of Example 1 was prepared so that it contained commercially available silicone oil (Product name: KF54 produced by Shin-Etsu Chemical Co., Ltd.) as lubricating liquid and 5 wt % of zinc particles (Product name: R Particle produced by Hakusui Chemical Co., Ltd.) whose diameter was about 20 μm. The zinc particles used for Example 1 was obtained by evaporative cooling.

<Forming of Sample Casting>

A sample casting made of an Mg alloy (AZ91D) was produced by using a molding apparatus 50 shown in FIG. 9. The apparatus 50 includes a vacuum chamber 51 and a vacuum pump 52 connected to the chamber 51, in which a pot of refractory material, or crucible 53 is arranged with dies 54. The crucible 53 is equipped with a heater 55. The crucible 53, together with the heater 55, can be inclined toward the dies 54 so that molten metal in the crucible 53 is poured into the cavity 54*a* of the dies 54. The cavity 54*a* is sized for forming a sample casting having a length of 60 mm, a width of 10 mm and a thickness of 3 mm.

The sample casting was produced in the following manner. First, the above-mentioned lubricant (silicone oil & 5 wt % of zinc particles) was sprayed onto the cavity-defining surfaces of the dies 54 by an amount of 1 ml/cm$^2$. The lubricant to be sprayed was taken from a beaker in which the lubricant was constantly agitated. The temperature of the dies 54 was kept at 130° C. As shown in FIG. 9, lumps of Mg alloy (AZ91D) were put in the crucible 53. Then, the chamber 51 was air-evacuated to $10^{-4}$ Torr, and the crucible 53 was heated so that its surface temperature was raised to about 650° C. This melted the Mg alloy lumps in the crucible 53. Thereafter, the crucible 53 was inclined to pour the molten Mg alloy into the cavity 54*a* of the dies 54. After the supplied Mg alloy was sufficiently cooled, the casting ("sample plate") was taken out from the dies 54. Based on this sample plate, measurement was conducted about the flow length, that is, how far the poured molten metal had flowed in the cavity 54*a* from the inlet 54*b* of the dies 54. In addition, the appearance of the sample plate was observed. The results are shown in TABLE given below. The appearance of the sample plate was evaluated by three grades. Specifically, the symbol ◎ in TABLE indicates that the sample plate had no defects including surface sink, surface wrinkle, etc. Likewise, the symbol ○ indicates that the sample plate had such defects at 1~3 locations, and the symbol Δ indicates that the sample plate had such defects at 4 or more locations.

EXAMPLES 2 AND 3

<Preparation of Lubricant>

The lubricant of Example 2 and the lubricant of Example 3 were prepared so that they contained the same silicone oil as used for Example 1. For lubricating particles, the lubricant of Example 2 contained 15 wt % of zinc particles (20 μm in diameter) while the lubricant of Example 3 contained 30 wt % of zinc particles (20 μm in diameter). With the use of these lubricants, sample plates were made, based on which the flow length measurement and the appearance observation were conducted. The results are shown in TABLE.

EXAMPLE 4

<Preparation of Lubricant>

The lubricant of Example 4 was prepared so that it contained commercially available silicone oil (Product name: KF54 produced by Shin-Etsu Chemical Co., Ltd.) and 15 wt % of Zn—Sn alloy particles having a diameter of 20 μm. The composition ratio of Zn to Sn was 9 to 1. The Zn—Sn alloy particles were obtained by mixing zinc and tin to make an alloy, and then freeze-shattering the alloy so that the diameter of each particle was the prescribed value. With the use of the thus prepared lubricant, a sample plate was produced, as in the case of Example 1, and the flow length measurement and the appearance observation were conducted. The results are shown in TABLE.

EXAMPLE 5

<Preparation of Lubricant>

The lubricant of Example 5 was prepared so that it contained commercially available, aqueous emulsion mold-releasing agent (Product name: Caster Ace produced by Nichibei Ltd.) and 15 wt % of Zn—Sn alloy particles having a diameter of about 8 μm. The composition ratio of Zn to Sn was 7 to 3. The Zn—Sn alloy particles were obtained by mixing zinc and tin to make an alloy, and then freeze-shattering the alloy so that the diameter of each particle was the prescribed value. With the use of the thus prepared lubricant, a sample plate was produced, as in the case of Example 1, and the flow length measurement and the appearance observation were conducted. The results are shown in TABLE.

EXAMPLE 6

<Preparation of Lubricant>

The lubricant of Example 6 was prepared so that it contained commercially available silicone oil (Product name: KF54 produced by Shin-Etsu Chemical Co. Ltd.) and 15 wt % of resinated particles. In this example, the resinated particles were obtained by melting polypropylene, and mixing zinc particles with it. The diameter of the zinc particles was about 20 μm. The weight ratio of the zinc particles to polypropylene was 6 to 4. The mixture was freeze-shattered to the desired size. The resultant resinated particle contained a zinc particle coated with polypropylene.

<Forming of Sample Casting>

With the use of the lubricant of Example 6, a sample plate was formed in the same manner as in the case of Example 1 except that the temperature of the heated dies 54 (FIG. 9) was kept at 180° C. instead of 130° C. Based on the resultant sample plate, the flow length measurement and the appearance observation were conducted. The results are shown in TABLE.

EXAMPLE 7

<Preparation of Lubricant>

The lubricant of Example 7 was prepared so that it contained commercially available, aqueous emulsion mold-releasing agent (Product name: Caster Ace produced by Nichibei Ltd.) and 15 wt % of resinated particles. As in the case of Example 6, the resinated particles were obtained by melting polypropylene, and mixing zinc particles with it. The diameter of the zinc particles was about 20 μm. The weight ratio of the zinc particles to polypropylene was 6 to 4. With the use of the thus obtained lubricant, a sample plate was formed in the same manner as in the case of Example 1. Based on the sample plate, the flow length measurement and the appearance observation were conducted. The results are shown in TABLE.

Comparative Case 1

The lubricant of Comparative case 1 contained silicone oil only (Product name: KF54 produced by Shin-Etsu Chemical Co., Ltd.), which was not mixed with zinc particles or any other particles. With the use of this lubricant, a sample plate was formed in the same manner as in the case of Example 1. Based on the sample plate, the flow length measurement and the appearance observation were conducted. The results are shown in TABLE.

Comparative Case 2

The lubricant of Comparative case 2 contained commercially available, aqueous emulsion mold-releasing agent only (Product name: Caster Ace produced by Nichibei Ltd.), which was not mixed with zinc particles or any other particles. With the use of this lubricant, a sample plate was formed in the same manner as in the case of Example 1. Based on the sample plate, the flow length measurement and the appearance observation were conducted. The results are shown in TABLE.

TABLE

| | Contents of Lubricant | Particle Diameter of Lubricant (μm) | Coating | Flow Length (mm) | Appearance |
|---|---|---|---|---|---|
| Example 1 | Silicone Oil & Zn Particles (5 wt %) | 20 | None | 25 | ○ |
| Example 2 | Silicone Oil & Zn particles (15 wt %) | 20 | None | 30 | ◎ |
| Example 3 | Silicone Oil & Zn Particles (30 wt %) | 20 | None | 28 | ◎ |
| Example 4 | Silicone Oil & Zn—Sn (9:1) Particles (15 wt %) | 20 | None | 32 | ◎ |
| Example 5 | Aqueous Emulsion Mold-Releasing Agent & Zn—Sn (7:3) Particles (15 wt %) | 8 | None | 28 | ◎ |
| Example 6 | Silicone Oil & Resinated Particles (15 wt %) | 20 | Formed | 36 | ◎ |
| Example 7 | Aqueous Emulsion Mold-Releasing Agent & Resinated Particles (15 wt %) | 20 | Formed | 34 | ◎ |
| Case 1 | Silicone Oil | — | — | 20 | Δ |
| Case 2 | Aqueous Emulsion Mold-Releasing Agent | — | — | 18 | ○ |

<Evaluation of Examples 1~7 and Comparative cases 1~2>

TABLE shows that Examples 1~7 are superior to Comparative cases 1 and 2 in flow length (flowability) In particular, the flowability of Examples 2, 4 and 6 is improved by more than 50% in comparison with that of Comparative case 1 using the same lubricating liquid (silicone oil) as Examples 2, 4 and 6. Likewise, the flowability of Examples 5 and 7 is improved by more than 50% in comparison with that of Comparative case 2 using the same lubricating liquid (aqueous emulsion mold-releasing agent) as Examples 5 and 7. Further, it should be noted that Examples 6 and 7, which used resinated lubricating particles, are superior in flowability to other Examples 1~5. Regarding the appearance of the sample plates, Examples 1~7 produced glossy surfaces, whereas Comparative cases 1 and 2 did not.

EXAMPLE 8

<Die-Casting>

As the metal plate 10 shown in FIG. 5, use was made of a zinc plate (Zn-purity 99.99%, L1=100 mm, L2=50 mm, L3=2 mm and L4=0.3 mm). This zinc plate was put in the dies of a die-casting machine. A molten Mg alloy (AZ91D by ASTM), heated at 630° C., was injected into the dies heated at 250° C. The injecting pressure was 70 kgf/cm$^2$, and the injecting rate was 2.0 m/s. The zinc plate as a whole was melted into the molten alloy. After the metal was allowed to cool, the die was opened, and the sample casting was ejected. In this manner, one hundred of sample castings were produced.

<Quality Inspection>

The 100 sample castings were subjected to visual inspection to check for surface defects including cracks, chips, wrinkles, undulations, etc. The result was that all the sample castings had no such defects.

Comparative Case 3

One hundred of sample castings were produced in the same manner as in the case of Example 8 except that no metal plate was put in the dies. In this instance, 67 sample castings were found defective.

According to the present invention, as seen from the above, the flowability of molten metal can be improved by controlling the freezing point of the molten metal and/or reducing the friction between the molten metal and the cavity-defining surfaces of the dies. Owing to the improved flowability, it is possible to produce high-quality metal objects with thin walls.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A metal object forming method comprising:

apreliminary step of coating a molding die with a lubricant comprising flowability-improving metal particles which melt into molten metal and causes freezing point depression of the molten metal; and an injecting step of supplying the molten metal into the die for producing a casting.

2. A metal object forming method comprising:

a preliminary step of coating a molding die with a lubricant comprising a flowability-improving material which melts into molten metal and causes freezing point depression of the molten metal; and an injecting step of supplying the molten metal into the die for producing a casting, wherein the flowability-improving material comprises metal particles contained in lubricant, the lubricant being applied to a cavity-defining surface of the die at the preliminary step, and the molten metal being supplied at a temperature high enough to melt at least part of the metal particles at the injecting step.

3. The method according to claim 2, wherein the metal particles are coated with thermoplastic resin.

4. The method according to claim 3, wherein the thermoplastic resin is selected from a group including olefin resin, acrylic resin and styrene resin.

5. The method according to claim 2, wherein the metal particles have a diameter of 1~100 $\mu$m.

6. The method according to claim 2, wherein, the lubricant contains 5~30 wt % of the metal particles.

7. The method according to claim 2, wherein the flowability-improving improving metal includes zinc, and the molten metal includes magnesium.

8. The method according to claim 7, wherein the flowability-improving metal comprise an alloy containing 60~95 wt % of zinc and 5~40 wt % of tin.

9. A housing of an electronic device, wherein the housing is produced by the method according to claim 2.

10. A metal object forming method comprising:

a preliminary step of providing a molding die with flowability-improving material which melts into molten metal and causes freezing point depression of the molten metal; and an injecting step of supplying the molten metal into the die for producing a casting, wherein the flowability-improving material comprises metal particles contained in lubricant, the lubricant is applied to a cavity-defining surface of the die at the preliminary step, the molten metal is supplied at a temperature high enough to melt at least part of the metal particles at the injecting step, and the lubricant contains 5~30 wt % of the metal particles.

11. A metal object forming method comprising, a preliminary step of providing a molding die with flowability-improving material which melts into molten metal and causes freezing point depression of the molten metal; and an injecting step of supplying the molten metal into the die for producing a casting, wherein the flowability-improving material comprises a metal plate, the metal plate being disposed on a cavity-defining surface of the die at the preliminary step, and the molten metal is supplied at a temperature high enough to melt at least part of the metal plate at the injecting step.

12. A metal object forming method comprising:

a preliminary step of providing a molding die with flowability-improving material which melts into molten metal and causes freezing point depression of the molten metal; and an injecting step of supplying the molten metal into the die for producing a casting, wherein the flowability-improving material includes zinc, the molten metal includes magnesium, and the flowability-improving material comprises an alloy containing 60~95 wt % of zinc and 5~40 wt % of tin.

* * * * *